US009999964B2

(12) United States Patent
Hu

(10) Patent No.: US 9,999,964 B2
(45) Date of Patent: Jun. 19, 2018

(54) RATCHET WRENCH WITH TOOTH BREAKAGE RESISTANCE

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 116 days.

(21) Appl. No.: 15/251,525

(22) Filed: Aug. 30, 2016

(65) Prior Publication Data

US 2017/0326710 A1 Nov. 16, 2017

(30) Foreign Application Priority Data

May 10, 2016 (TW) ..... 105114428 A

(51) Int. Cl.
*B25B 13/46* (2006.01)
*B25B 23/00* (2006.01)

(52) U.S. Cl.
CPC ..... *B25B 13/465* (2013.01); *B25B 23/0035* (2013.01)

(58) Field of Classification Search
CPC ..... B25B 13/465; B25B 23/0035
USPC ..... 81/62
See application file for complete search history.

(56) References Cited

U.S. PATENT DOCUMENTS 6,457,386 B1 10/2002 Chiang
8,973,476 B2 * 3/2015 Reynertson, Jr. ... B25B 23/1422 81/478
9,114,511 B1 * 8/2015 Wang ..... B25B 13/465
2017/0326711 A1 * 11/2017 Hu ..... B25B 23/0035

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A ratchet wrench with tooth breakage resistance includes a body having a driving hole and a transmission hole intersecting with the driving hole. An inner periphery of the driving hole includes two adjoining portions on opposite sides of the transmission hole. An arcuate portion extends between the two adjoining portions. A separate tooth breakage preventing device is mounted in the arcuate portion and includes a contact face in contact with one of first and second outer toothed sections of either of two first pawls to prevent tooth breakage between a toothed portion of the driving hole and the one of the first and second outer toothed sections of either of the first pawls when the body is rotated to provide a ratcheting function for driving the fastener.

11 Claims, 12 Drawing Sheets

RATCHET WRENCH WITH TOOTH BREAKAGE RESISTANCE

BACKGROUND OF THE INVENTION

The present invention relates to a ratchet wrench and, more particularly, to a ratchet wrench with tooth breakage resistance.

FIG. 6 of the drawings is a schematic diagram corresponding to FIG. 8 of U.S. Pat. No. 6,457,386. U.S. Pat. No. 6,457,386 discloses a ratchet wrench 2 including a driving member 23 having a chamber 231 in which a pair of first pawls 24 and a pair of second pawls 25 are mounted. A first annular gear 27 encloses one of the first pawls 24 and one of the second pawls 25. A second annular gear 27 encloses the other first pawl 24 and the other second pawl 25. A main body 21 of the ratchet wrench 2 includes a groove 212 for receiving the drive member 23 and a through-hole 211 communicating with the groove 212. Each of the first and second annular gears 27 includes a plurality of inner periphery teeth 271 and a plurality one-sided teeth 272. An inner periphery defining the groove 212 includes a plurality of inner teeth 215. First and second outer teeth 241, 241' on the first pawls 24 and first and second outer teeth 251, 251' on the second pawls 25 selectively engage with the inner teeth 215 of the groove 212 and the inner periphery teeth 271 of the first and second annular gears 27, prohibiting movement in a direction. The one-sided teeth 272 of the first and second annular gears 27 engage with a bevel gear 221 on an end of a drive shaft 22 to provide transmission in the reverse direction. FIG. 7 of U.S. Pat. No. 6,457,386 shows the thickness of the second pawls 25 along a rotating axis of the drive member 23 is smaller than a diameter of the through-hole 211.

When the control member 26 is pivoted, the second pawls 25 pivot to permit the first outer teeth 251 or the second outer teeth 251' of the second pawls 25 to engage with the inner periphery teeth 271 of the first and second annular gears 27, thereby adjusting the rotating direction of the drive member 23. In the state shown in FIG. 6, the first outer teeth 241 of the first pawls 24 engage with the inner teeth 215 of the groove 212, and the first outer teeth 251 of the second pawls 25 engage with the inner periphery teeth 271 of the first and second annular gears 27. Since the one-sided teeth 272 of the first and second annular gears 27 engage with the bevel gear 22 on the drive shaft 22 to permit transmission in the reverse direction, when one of the first and second annular gears 27 rotate idly, the other of the first and second annular gears 27 drives the drive member 23 to rotate. During rotation in the reverse direction, both first and second annular gears 27 rotate idly. Thus, the drive member 23 can be driven to rotate relative to the groove 212 in either direction. Thus, a user can firstly rotate the drive shaft 22 to actuate the first and second annular gears 27 via the bevel gear 221, thereby rapidly driving the drive member 23 to tighten a fastener (not shown) to a certain extent, but not achieving the completely tightened state or a desired tightened state demanded by the user.

FIG. 7 is a diagram showing a continuing operation on the ratchet wrench in the state shown in FIG. 6. Specifically, the user operates the main body 21 to rotate the drive member 23 in the counterclockwise direction. Due to engagement between the first outer teeth 241 of the first pawls 24 and the inner teeth 215 of the groove 212 and due to the engagement between the first outer teeth 251 of the second pawls 25 and the inner periphery teeth 271 of the first and second annular gears 27 (which permits movement in a single direction), the drive member 23 rotates relative to the groove 212 and drives the fastener to the desired tightness demanded by the user. Since the thickness of the first and second pawls 25 is smaller than the diameter of the through-hole 211, one of the second pawls 25 falls into the through-hole 211 of the main body 21 and comes into contact with the end of the drive shaft 22 during the rotation of the drive member 23 relative to the groove 212.

FIG. 8 is a diagram showing a continuing operation on the ratchet wrench in the state shown in FIG. 11. Specifically, the user operates the main body 21 to rotate the drive member 23 in the clockwise direction. The first and second pawls 24 and 25 pivot relative to the drive member 23, such that the first outer teeth 241 of the first pawls 24 disengage from the inner teeth 215 of the groove 212 and such that the first outer teeth 251 of the second pawls 25 disengage from the inner periphery teeth 271 of the first and second annular gears 27. At this time, the groove 212 rotates idly relative to the drive member 23. Namely, the drive member 23 is not driven and, thus, provides a ratcheting function. After the user stops rotating the main body 21, the first outer teeth 241 of the first pawls 24 and the first outer teeth 251 of the second pawls 25 respectively reengage with the inner teeth 215 of the groove 212 and the inner periphery teeth 271 of the first and second annular gears 27 under the action of the compression springs S2 and the balls R.

When the user rapidly and repeatedly proceed with the driving rotation and the idle rotation, the drive member 23 rotates relative to the groove 212 before the drive member 23 reaches a position shown in FIG. 9. FIGS. 9 and 10 show that the first pawls 24 are pressed by the balls R biased by the compression springs S2. Before complete engagement between the inner teeth 215 of the groove 212 adjacent to the through-hole 211 (see circled portion D), only one of the first outer teeth 251 of the second pawl 25 engages with one of the inner teeth 215 in the groove 212 adjacent to the through-hole 211. Furthermore, the single-tooth engagement is not complete or is called a non-complete engagement. Namely, the contact area between these two teeth 251 and 215 shown in FIG. 10 is relatively small.

With reference to FIGS. 11 and 12, if the fastener coupled with the drive member 23 requires a large torque to reach the desired tightness demanded by the user, when the user applies a force while the first outer teeth 251 of the second pawl 25 and the inner teeth 215 in the groove 212 adjacent to the through-hole 211 have a small contact area and the non-complete engagement therebetween, a section of the one of the inner teeth 215 of groove 212 facing the through-hole 211 does not have any mechanism to withstand the force acting on the one of the outer teeth 251 of the second pawl 25. As a result, the one of the inner teeth 251 of the second pawl 25, the one of the inner teeth of the groove 212 cannot withstand the torque, leading to tooth breakage, particularly the one of the inner teeth 215 of the groove 212 adjacent to the through-hole 211.

Conclusions as a result, the user applies a force to rotate the main body 21, while the first outer teeth 251 of the second pawl 25 and the inner teeth 215 in the groove 212 adjacent to the through-hole 211 have a small contact area and the non-complete engagement therebetween. When only one of the first outer teeth 251 of the second pawl 25 non-complete engages with one of the inner teeth 215 in the groove 212 adjacent to the through-hole 211, the section of the one of the inner teeth 215 of groove 212 facing the through-hole 211 does not have any mechanism to withstand the force acting on the one of the outer teeth 251 of the second pawl 25, leading to tooth breakage.

Thus, a need exists for a novel ratchet wrench with tooth breakage resistance.

BRIEF SUMMARY OF THE INVENTION

A ratchet wrench according to the present invention includes a body having driving hole and a transmission hole intersecting with the driving hole. The driving hole includes an inner periphery having a toothed portion with a plurality of teeth. The inner periphery of the driving hole includes two adjoining portions on opposite sides of the transmission hole in a circumferential direction of the driving hole. An arcuate portion extends between the two adjoining portions and extends across the transmission hole in the circumferential direction of the driving hole.

The ratchet wrench further includes driving device rotatably received in the driving hole and adapted to drive a fastener. The driving device includes a driving member and two first pawls pivotably mounted to the driving member. Each of the first pawls includes first and second outer toothed sections. Each of the first and second outer toothed sections has a plurality of teeth. The first and second outer toothed sections of at least one of the first pawls are selectively engaged with the toothed portion of the driving hole. A transmission device is rotatably mounted in the transmission hole. The transmission device is configured to drive the driving member to rotate relative to the driving hole about a rotating axis.

A tooth breakage preventing device is mounted to an end of the transmission hole in the arcuate portion of the driving hole and is located in the arcuate portion. The tooth breakage preventing device is a separate member assembled with the body. The tooth breakage preventing device includes a contact portion configured to be in contact with one of the first and second outer toothed sections of either of the two first pawls to prevent tooth breakage between the toothed portion of the driving hole and the one of the first and second outer toothed sections of either of the two first pawls when the body is rotated to provide a ratcheting function for driving the fastener. The contact portion includes a height extending from a circumference of a root circle of the toothed portion towards the driving hole in a radial direction of the root circle. Each of the plurality of teeth of the toothed portion of the driving hole has a tooth height not larger than the height of the contact portion.

In an embodiment, the height of the contact portion is larger than the tooth height of the toothed portion of the driving hole, and the contact portion is a protrusion extending from the circumference of the root circle of the toothed portion towards the driving hole in the radial direction of the root circle.

In an embodiment, the driving hole is defined in an end of the body and extends along the rotating axis. The contact portion of the tooth breakage preventing device has an arc length in the circumferential direction of the driving hole centered on the rotating axis. Each of the two first pawls includes an arcuate section between the first and second outer toothed sections. Each of the first and second outer toothed sections includes a plurality of teeth. Each of the plurality of teeth of each of the first and second outer toothed sections has a tooth thickness. A ratio of the arc length to the tooth thickness is not smaller than 0.5.

In an example, two of the plurality of teeth of the toothed portion of the driving hole respectively adjacent to the two adjoining portions respectively have two first contact faces. The contact portion includes two second contact faces. Each of the two second contact faces is contiguous to one of two ends of the arcuate face. Each of the two first contact faces and one of the two second contact faces define a tooth groove that is selectively in contact with and engaged with one of the first and second outer toothed sections of either of the two first pawls.

In another example, the contact portion includes a plurality of teeth having a plurality of tooth grooves selectively in contact with and engaged with one of the first and second outer toothed sections of either of the two first pawls. The plurality of tooth grooves is arranged in the circumferential direction of the driving hole. Two of the plurality of tooth grooves are respectively connected to two ends of the toothed portion of the driving hole. The plurality of teeth of the contact portion and the plurality of teeth of the tooth portion of the driving hole together form a complete circle centered in the rotating axis of the driving member.

In an example, the tooth breakage preventing device includes first and second ends spaced from each other along a longitudinal axis of the body perpendicular to the rotating axis. The tooth breakage preventing device further includes an axial hole extending from the first end through the second end along the longitudinal axis. The tooth breakage preventing device further includes a compartment located between the first and second ends and intersecting with the axial hole. The compartment includes upper and lower openings. The transmission device includes a transmission shaft rotatably received in the transmission hole and having an end received in the compartment. A gear is mounted on the end of the transmission shaft and is received in the compartment. The driving device further includes two second pawls pivotably mounted to the driving member and two ring gears rotatably received in the driving hole. Each of the two ring gears includes an inner toothed portion and a side toothed portion. The side toothed portions of the two ring gears respectively mesh with the gear via the upper and lower openings. Each of the two second pawls includes two outer toothed sections selectively engaged with the inner toothed portion of one of the two ring gears.

The ratchet wrench can further include a direction switching device operably coupled to the two first pawls and the two second pawls. The direction switching device is configured to change an engagement status between the two ring gears and the two first pawls and the two second pawls to change a ratcheting direction in which the fastener is driven by the driving member.

The present invention will become clearer in light of the following detailed description of illustrative embodiments of this invention described in connection with the drawings.

DETAILED DESCRIPTION OF THE INVENTION

Figure 1:
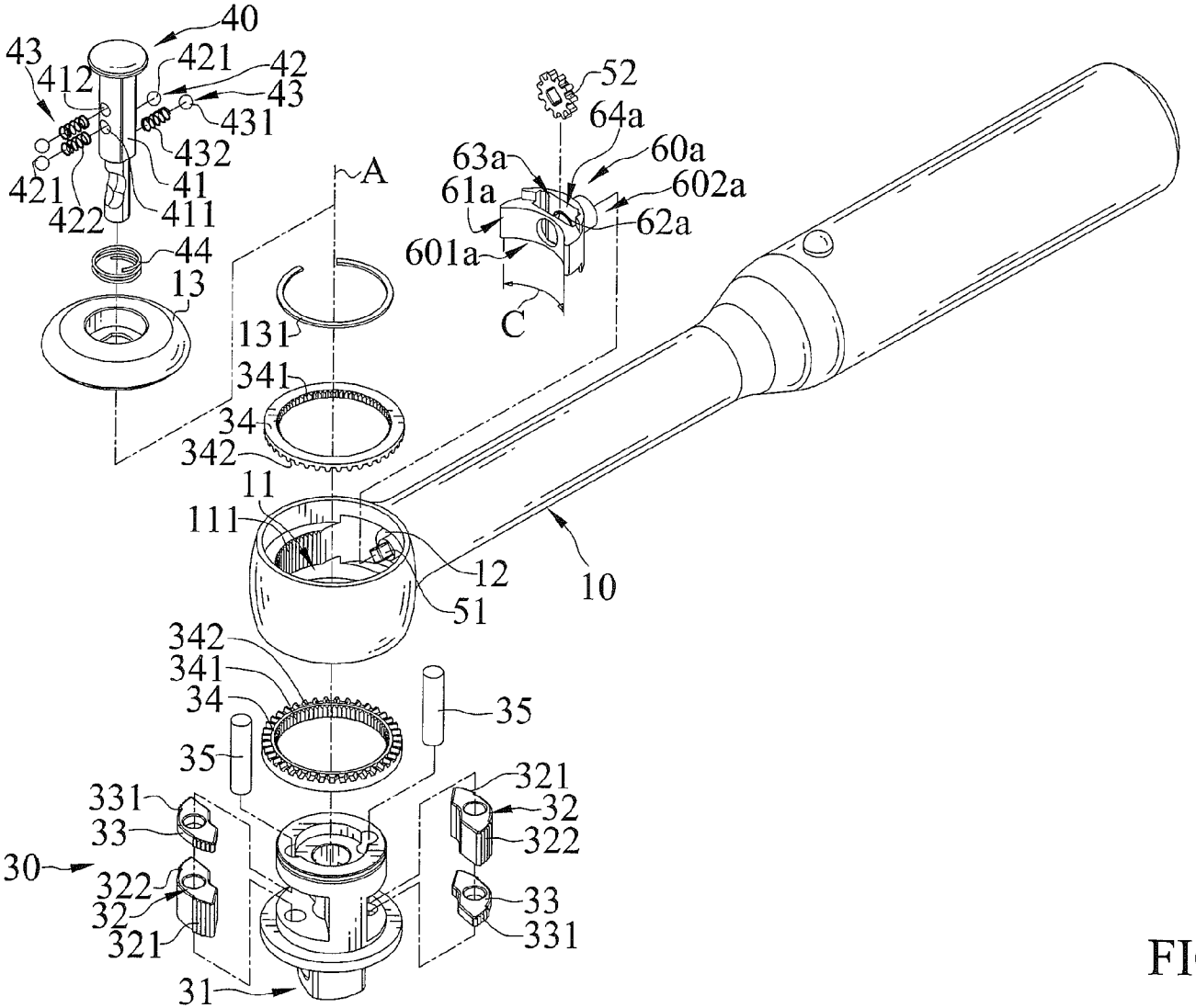
FIG. 1 is an exploded, perspective view of a ratchet wrench with tooth breakage resistance of a first embodiment according to the present invention.
Figure 2:
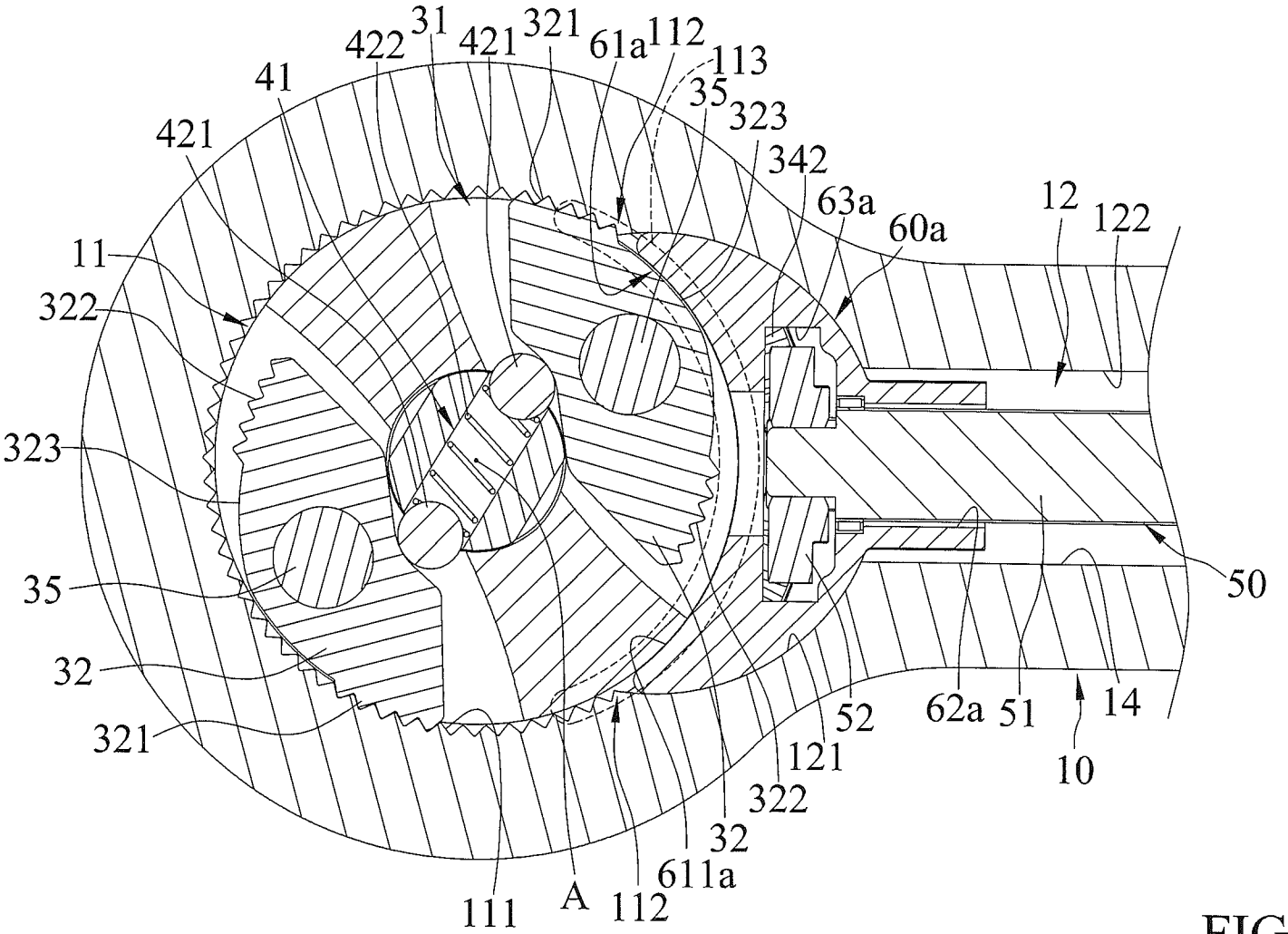
FIG. 2 is a partial, cross sectional view of the ratchet wrench of FIG. 1, illustrating an engagement status between two first pawls and a toothed portion of a driving hole.
Figure 3:
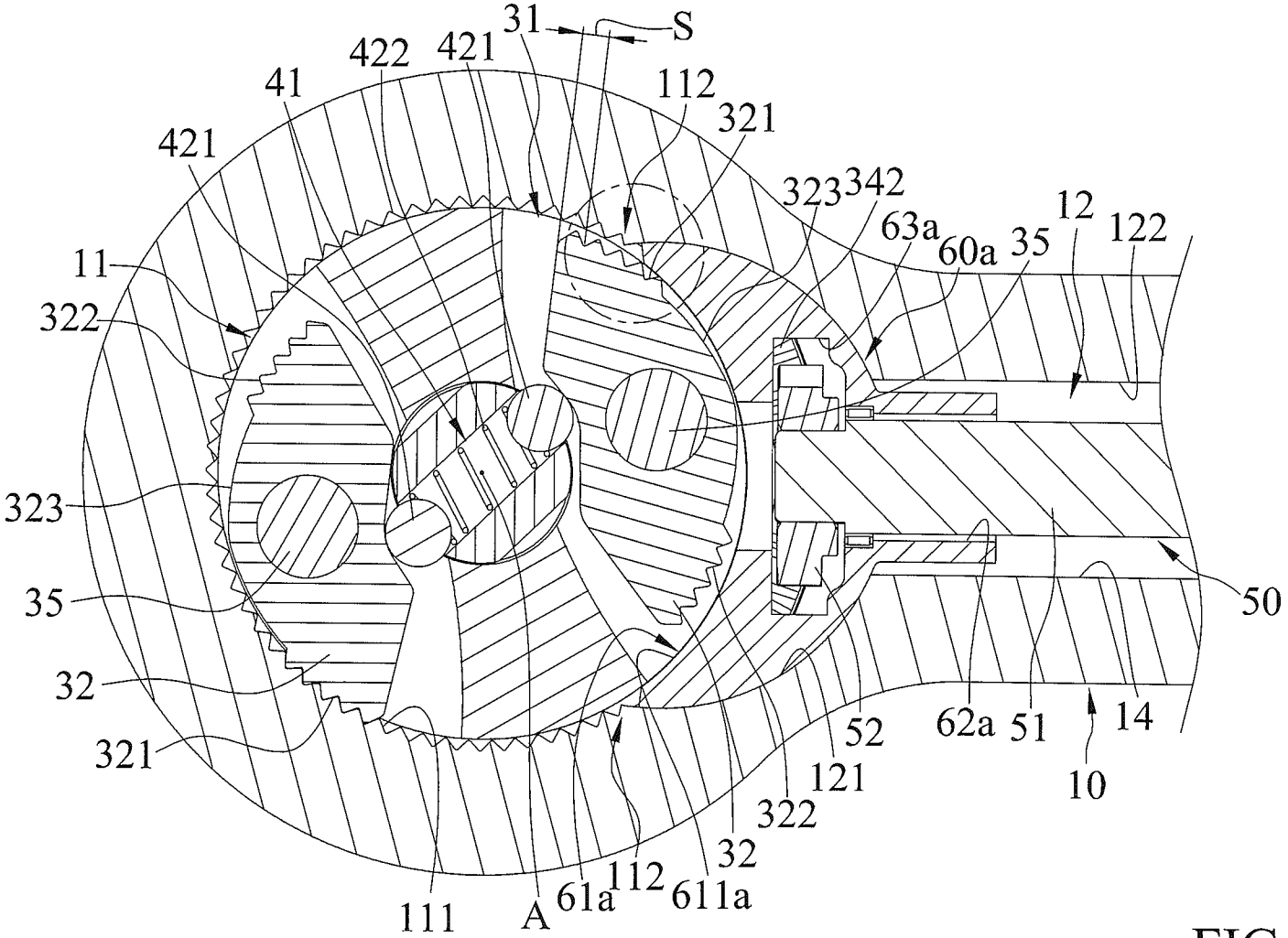
FIG. 3 is a view similar to FIG. 2, illustrating another engagement status between the two first pawls and the toothed portion of the driving hole.
Figure 4:
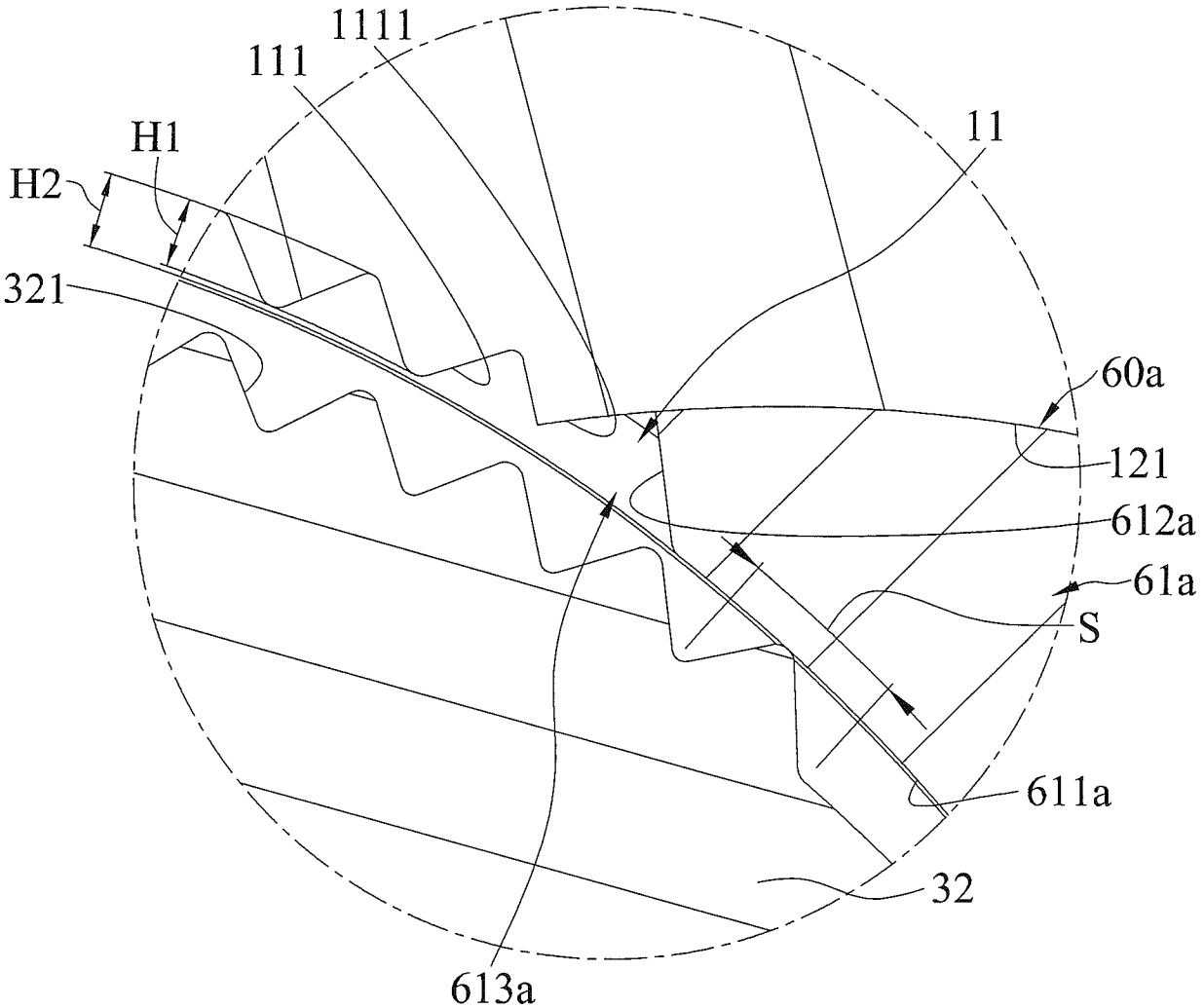
FIG. 4 is an enlarged view of a circled portion of FIG. 3.

With reference to FIGS. 1-5, a ratchet wrench with tooth breakage resistance of a first embodiment according to the present invention includes a body 10, a driving device 30, a transmission device 50, and a tooth breakage preventing device 60.

Body 10 includes a driving hole 11 and a transmission hole 12 intersecting with the driving hole 11. Driving hole 11 includes an inner periphery having a toothed portion 111 with a plurality of teeth. Transmission hole 12 has an end located in the inner periphery of driving hole 11. The inner periphery of the driving hole 11 includes two adjoining portions 112 located on opposite sides of the end of transmission hole 12 and spaced from each other in a circumferential direction of driving hole 11. In this embodiment, adjoining portions 112 are symmetric to each other. An arcuate portion 113 extends between the two adjoining portions 112 and extends across transmission hole 12 in the circumferential direction of driving hole 11. In this embodiment, arcuate portion 113 extends through about 145/180 $\pi$ rad (about 145°). Each tooth of toothed portion 111 has a tooth height H1.

Driving hole 11 is defined in an end of body 10 and extends along a rotating axis A. Transmission hole 12 includes a first portion 121 intercommunicated with driving hole 11 and a second portion 122 intercommunicated with first portion 121. The two adjoining portions 112 are on opposite sides of first portion 121 in the circumferential direction of driving hole 11.

In this embodiment, body 10 further includes a cap 13 for closing driving hole 11 through a retaining member 131.

Driving device 30 is rotatably received in driving hole 11 and is adapted to drive a fastener, such as a bolt, a nut, or a socket. Driving device 30 includes a driving member 31 and two first pawls 32 pivotably mounted to driving member 31. Each first pawl 32 includes first and second outer toothed sections 321 and 322. Each of first and second outer toothed sections 321 and 322 has a plurality of teeth. First and second outer toothed sections 321 and 322 of at least one of first pawls 32 are selectively engaged with toothed portion 111 of driving hole 11.

In this embodiment, each first pawl 32 includes an arcuate section 323 between first and second outer toothed sections 321 and 322.

Driving device 30 further includes two second pawls 33 pivotably mounted to driving member 31 and two ring gears 34 rotatably received in driving hole 11. Each ring gear 34 includes an inner toothed portion 341 and a side toothed portion 342. Each second pawl 33 includes two outer toothed sections 331 selectively engaged with inner toothed portion 341 of one of ring gears 34. Ring gears 34 can rotate about rotating axis A in the clockwise direction or the counterclockwise direction relative to driving member 31 and are located on opposite sides of driving member 31 along rotating axis A. Side toothed portion 342 of each ring gear 34 engages with and can be driven by transmission device 50.

Driving device 30 further includes two pins 35 extending through driving member 31, first pawls 32 and second pawls 33, such that each first pawl 32 and each second pawl 33 are pivotably mounted to driving member 31 and are pivotable about pins 35. In this embodiment, each first pawl 32 has a thickness along rotating axis A not larger than a diameter of transmission hole 12. Preferably, the thickness of each first pawl 32 is smaller than the diameter of transmission hole 12.

Transmission device 50 is rotatably mounted in the transmission hole 12 and is configured to drive driving member 31 to rotate relative to driving hole 11 about rotating axis A. Transmission device 50 includes a transmission shaft 51 rotatably received in second portion 122 of transmission hole 12. A gear 52 is mounted on an end of transmission shaft 51 and meshes with side toothed portions 342 of ring gears 34. Transmission shaft 51 can be driven manually or driven with a power to rapidly rotate relative to transmission hole 12.

A tooth breakage preventing device 60*a* is mounted to an end of the transmission hole 12 in arcuate portion 113 and is located in arcuate portion 113. Furthermore, tooth breakage preventing device 60*a* is a separate member assembled with body 1. Tooth breakage preventing device 60*a* includes a contact portion 61*a* formed on an end thereof. When tooth breakage preventing device 60*a* is assembled to first portion 121 of transmission hole 12, contact portion 61*a* is located in arcuate portion 113. Contact portion 61*a* is configured to be in contact with one of first and second outer toothed sections 321 and 322 of either of the two first pawls 32 to prevent tooth breakage between toothed portion 111 of driving hole 11 and the one of first and second outer toothed sections 321 and 322 of either of the two first pawls 32 when body 10 is rotated to provide a ratcheting function for driving the fastener.

The contact portion 61*a* and has a height H2 extending from a circumference of a root circle of toothed portion 111 towards driving hole 11 in a radial direction of the root circle of toothed portion 111. Tooth height H1 of toothed portion 111 is not larger than height H2 of contact portion 61*a*. In this embodiment, height H2 of contact portion 61*a* is larger than tooth height H1 of toothed portion 111 of driving hole 11, and contact portion 61*a* is in the form of a protrusion extending from the circumference of the root circle of toothed portion 111 towards driving hole 11 in the radial direction of the root circle of toothed portion 111.

In this embodiment, contact portion 61*a* has an arcuate face 611*a* selectively in contact with one of first and second outer toothed sections 321 and 322 of either of the two first pawls 32. This prevents tooth breakage resulting from application of a force by the user in a single-tooth engagement state before complete engagement between toothed portion 111 of driving hole 11 and first outer toothed section 321 or second outer toothed section 322.

Contact portion 61*a* of tooth breakage preventing device 60*a* has an arc length C in the circumferential direction of driving hole 11 centered on rotating axis A. Each tooth of each of first and second outer toothed sections 321 and 322 has a tooth thickness S. A ratio C/S of arc length C to tooth thickness S is not smaller than 0.5. In this embodiment, the ratio C/S is about 1.5. By such an arrangement, when driving member 31 rotates relative to driving hole 11, either of first pawls 32 comes in contact with contact portion 61*a* to avoid one of the teeth of first and second outer toothed sections 321 and 322 of either of first pawls 32 from contacting with one of the teeth of toothed portion 111 contiguous to a corresponding adjoining portion 112.

Furthermore, two teeth of toothed portion 111 of driving hole 11 respectively adjacent to the two adjoining portions 12 have two first contact faces 1111, respectively. Contact portion 61*a* includes two second contact faces 612*a*. Each second contact face 612*a* is contiguous to one of two ends of arcuate face 611*a*. Each first contact face 1111 and the one of the two second contact faces 612*a* define a tooth groove 613*a* that is selectively in contact with and engaged with one of first and second outer toothed sections 321 and 322 of either of the two first pawls 32.

A direction switching device 40 is operably coupled to first pawls 32 and second pawls 33. Direction switching device 40 extends through driving member 31 along rotating axis A. Direction switching device 40 is configured to change an engagement status between ring gears 34 and first and second pawls 32 and 33 to change a ratcheting direction in which the fastener is driven by driving member 31. In this embodiment, direction switching device 40 includes a direction switching rod 41 extending through cap 13 and driving member 31 and a first pressing unit 42. Direction switching rod 41 is movable between two positions corresponding to a driving direction and a non-driving direction. Direction switching rod 41 includes a through-hole 411 extending in a direction perpendicular to rotating axis A for receiving first pressing unit 42. First pressing unit 42 includes two pressing members 421 and a biasing element 422 between pressing members 421. Each pressing member 421 is biased by biasing element 422 to press against one of first pawls 32. Direction switching device 40 further includes a returning spring 44 attached between direction switching rod 41 and cap 13 for returning purposes.

Direction switching rod 41 further includes two receptacles 412 respectively receiving two second pressing units 43. Each second pressing unit 43 includes a pressing member 431 and a biasing element 432 for biasing pressing member 431 to press against one of second pawls 33.

A user can rapidly drive transmission shaft 51 to rotate. Due to the engagement between gear 52 and side toothed portions 342 of ring gears 34 and the engagement between inner toothed portions 341 of ring gears 34 and outer toothed sections 331 of second pawls 33, driving member 31 is driven to rotate relative to driving hole 11, thereby rapidly driving the fastener.

When the fastener has been tightened to an extent, in order to reach the tightness demanded by the user, body 10 is rotated in the counterclockwise direction. Due to the engagement status between first outer toothed sections 321 or second outer toothed sections 322 of first pawls 32 and toothed portion 111 of driving hole 11, driving member 31 is further rotated relative to driving hole 11 to further drive the fastener. Then, the user can rotate body 10 in the clockwise direction, such that first outer toothed sections 321 or second outer toothed sections 322 of first pawls 32 disengage from and then reengage with toothed portion 111 of driving hole 11.

During repeated clockwise and counterclockwise rotations of body 10 to provide the ratcheting function, driving member 31 rotates relative to driving hole 11. When either of first pawls 32 reaches arcuate portion 113, contact portion 61 in the form of a protrusion comes into contact with first outer toothed section 321 or second outer toothed section 322 of the first pawl 32. Since height 112 is larger than tooth height H1, contact portion 61*a* avoids any tooth of first outer toothed section 321 or second outer toothed section 322 of the first pawl 32 from contacting with one of the teeth of toothed portion 111 contiguous to the corresponding adjoining portion 112. This prevents tooth breakage resulting from application of a force by the user in a single-tooth engagement state before complete engagement between toothed portion 111 of driving hole 11 and first outer toothed section 321 or second outer toothed section 322.

Furthermore, the ratio of arc length C to tooth thickness S is not smaller than 0.5, such that a manufacturer of the ratchet wrench with tooth breakage resistance according to the present invention can adjust arc length C of each contact portion 61 according to tooth thickness S. This assures either of contact portions 61 comes into contact with either of first pawls 32 while driving member 31 rotates relative to driving hole 11, achieving the tooth breakage preventing effect.

Furthermore, each tooth groove 613*a* of contact portion 61*a* is selectively in contact with and engaged with one of first and second outer toothed sections 321 and 322 of either of the two first pawls 32. The force applied by the user is distributed to the structure of tooth breakage preventing device 60*a*. This avoids tooth breakage of conventional ratchet wrenches resulting from single-tooth engagement state without additional structure for withstanding the force.

In this embodiment, tooth breakage preventing device 60*a* includes first and second ends 601*a* and 602*a* spaced from each other along a longitudinal axis of body 10 perpendicular to rotating axis A. Tooth breakage preventing device 60*a* further includes an axial hole 62*a* extending from first end 601*a* through second end 602*a* along the longitudinal axis. Tooth breakage preventing device 60 further includes a compartment 64*a* located between first and second ends 601*a* and 602*a* and intersecting with axial hole 62*a*. Compartment 64*a* includes upper and lower openings 63*a*. Transmission shaft 51 has an end received in compartment 64*a*. Gear 52 is mounted on the end of the transmission shaft 51 and is received in compartment 64*a*. Side toothed portions 342 of ring gears 34 respectively mesh with gear 52 via upper and lower openings 63*a*.

Figure 5:
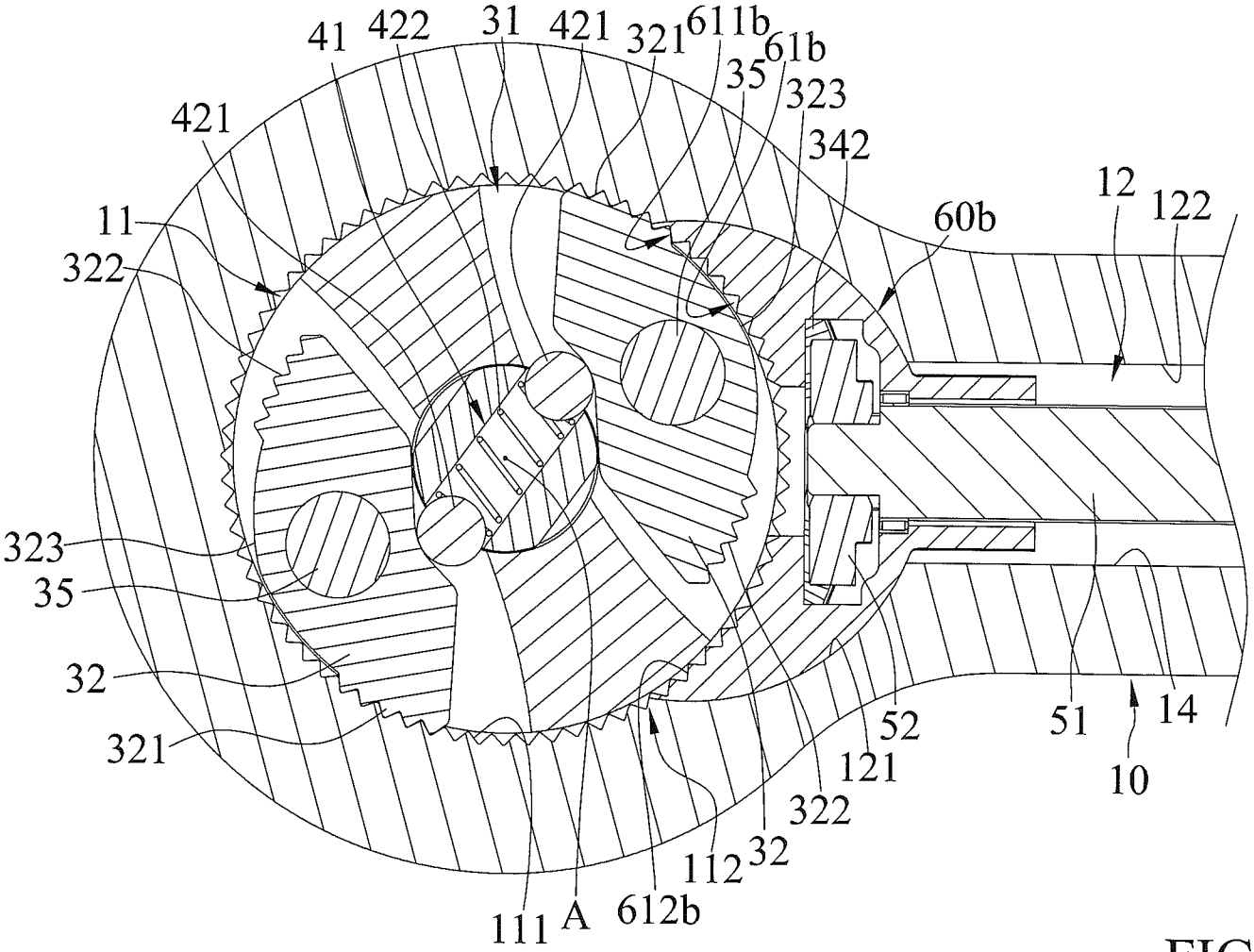
FIG. 5 is a partial, cross sectional view illustrating a ratchet wrench with tooth breakage resistance of a second embodiment according to the present invention.
Figure 6:
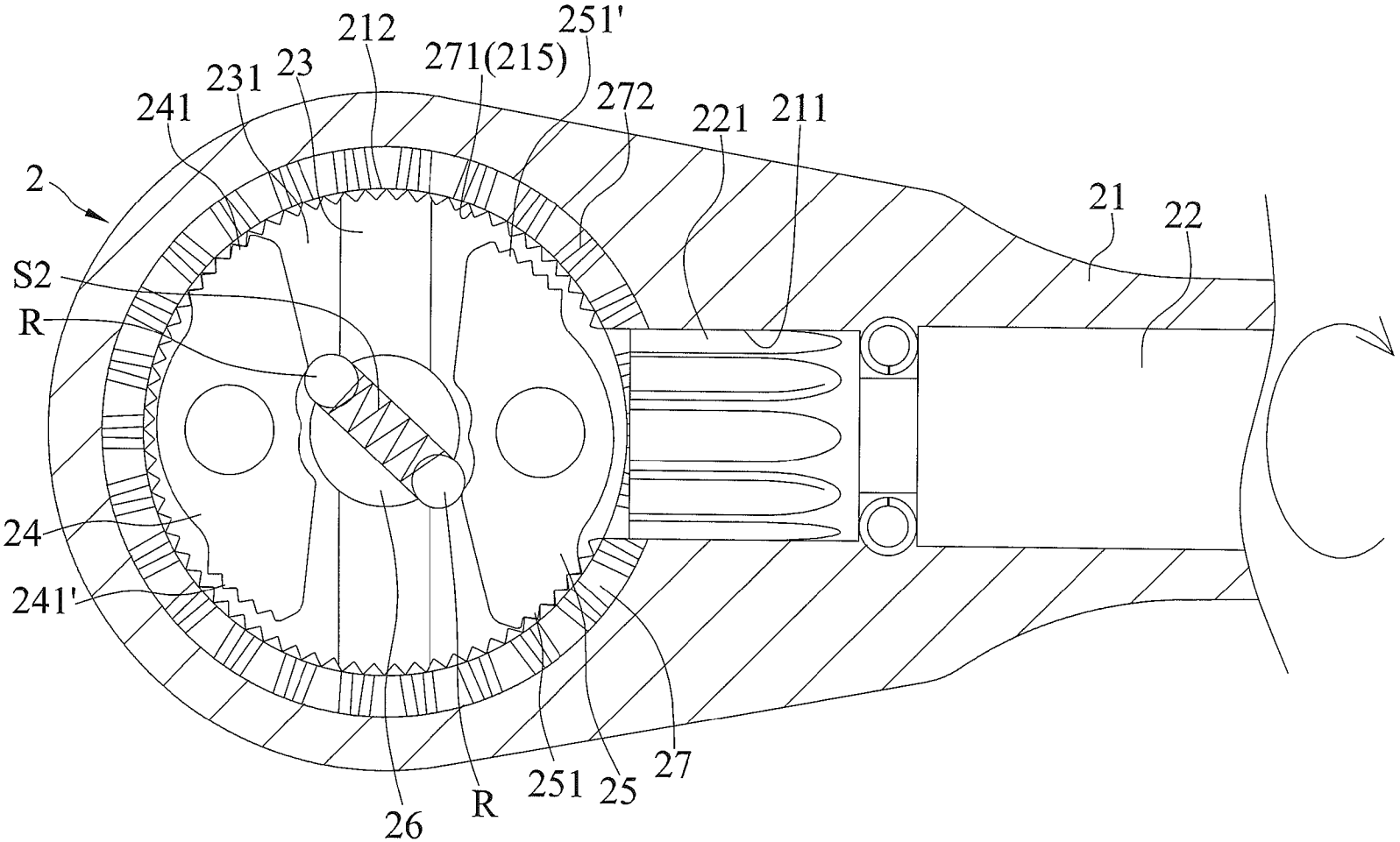
FIG. 6 PRIOR ART
FIG. 6 is a diagram of a conventional ratchet wrench, with two first outer teeth of two first pawls engaged with inner teeth of a groove of a main body of the conventional ratchet wrench.
Figure 7:
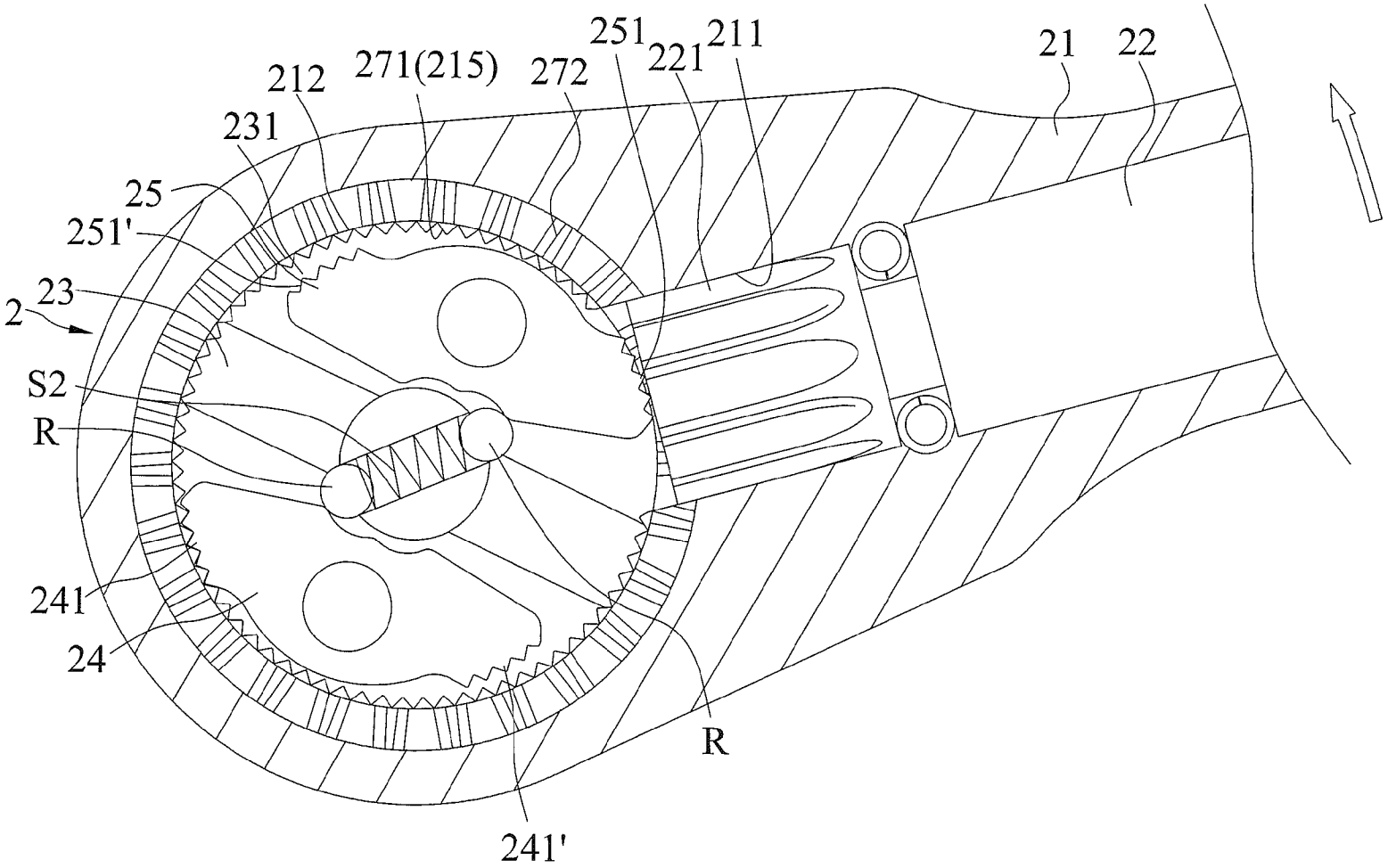
FIG. 7 PRIOR ART
FIG. 7 is a diagram showing a continuing operation on the ratchet wrench in the state shown in FIG. 6, with the main body rotated in the counterclockwise direction and with one of the first pawls fallen into a through-hole of the main body and in contact with an end of a drive shaft.
Figure 8:
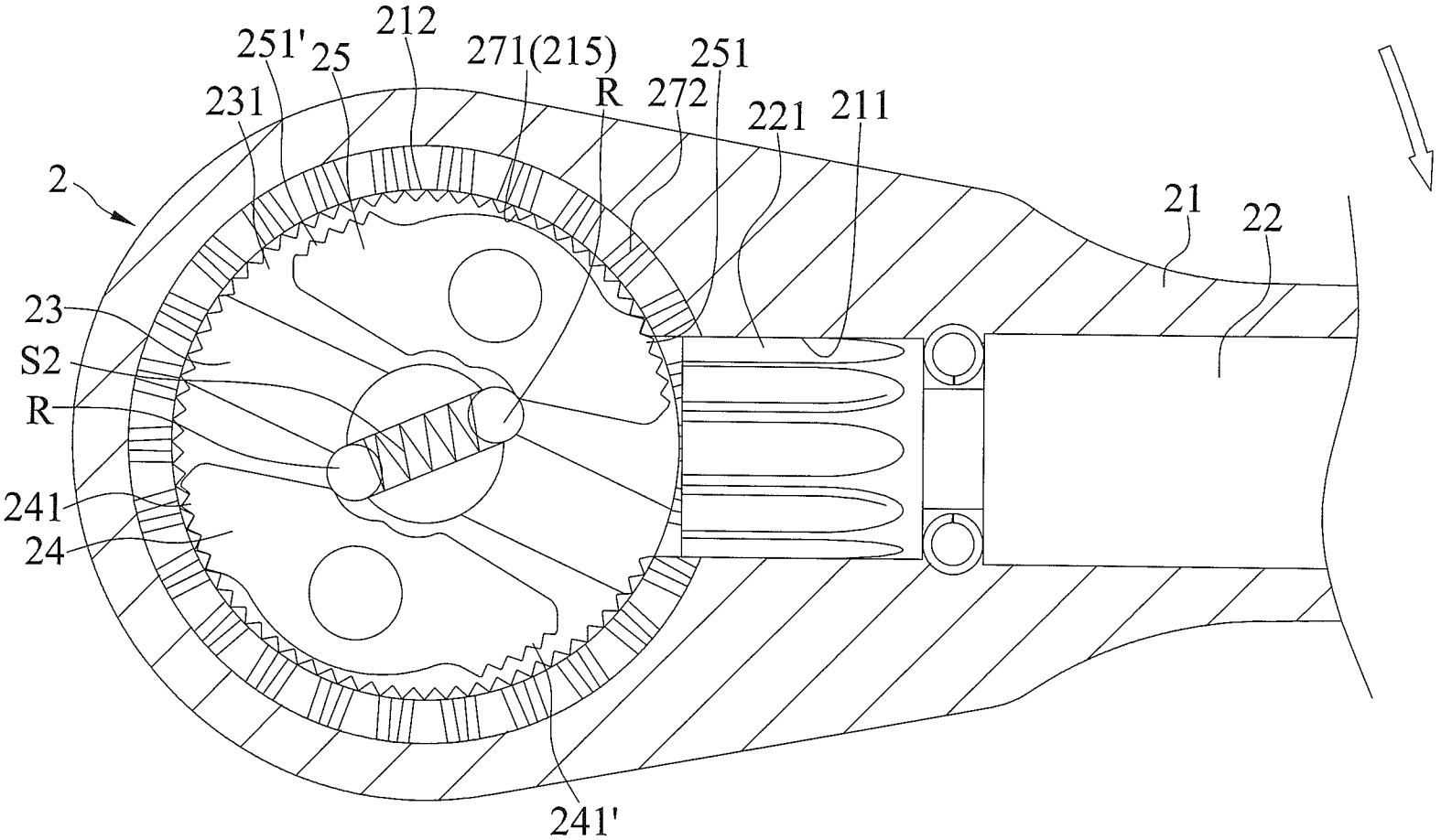
FIG. 8 PRIOR ART
FIG. 8 is a diagram showing a continuing operation on the ratchet wrench in the state shown in FIG. 7, with the main body rotated in the clockwise direction, with the first pawls and the inner teeth of the groove providing a ratcheting function, and with the drive member rotated idly.
Figure 9:
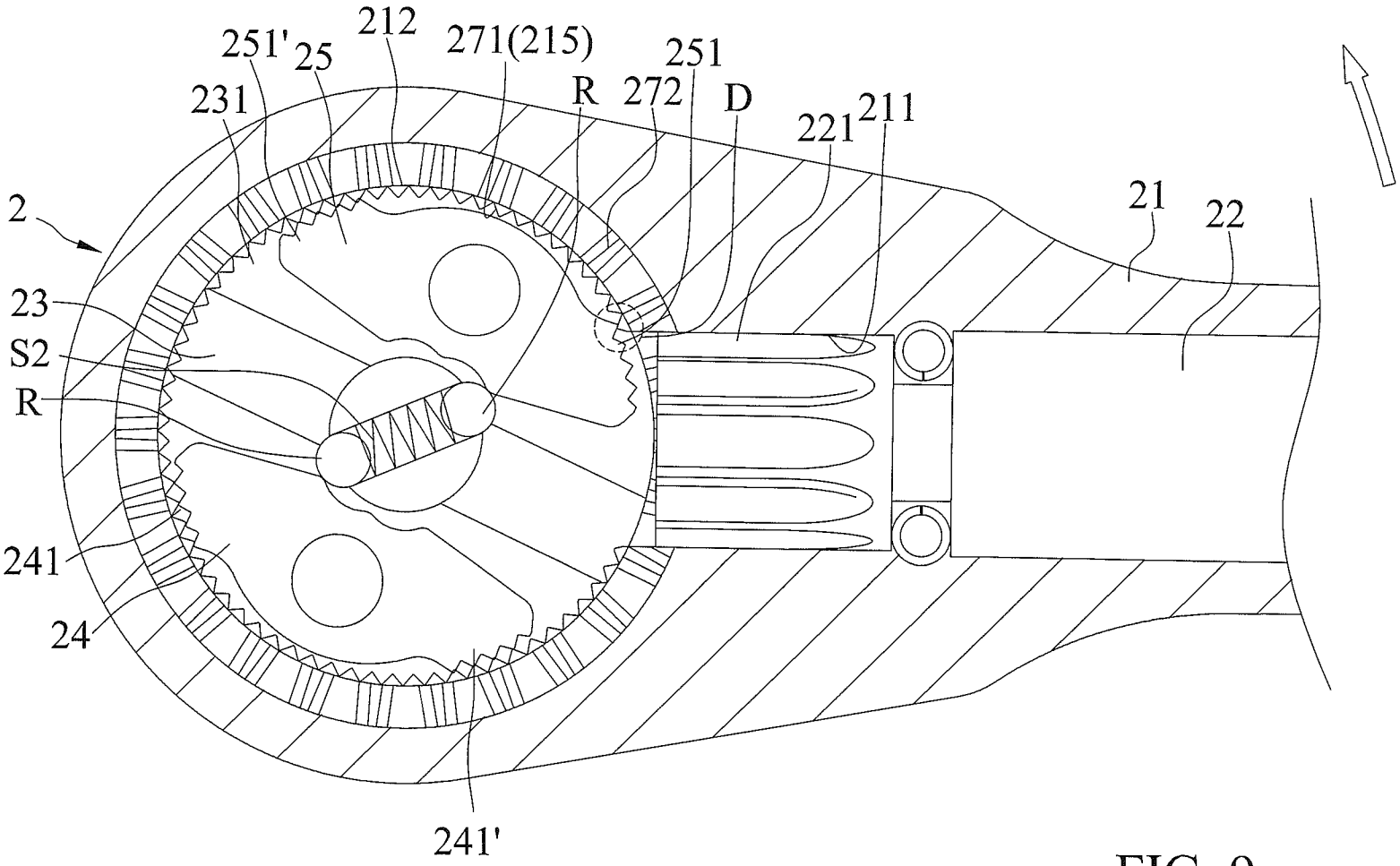
FIG. 9 PRIOR ART
FIG. 9 is a diagram illustrating a state immediately before FIG. 8, with only one of the first outer teeth of a second pawl engaged with one of the inner teeth in the groove adjacent to a through-hole of the main body by a relatively small contact area.
Figure 10:
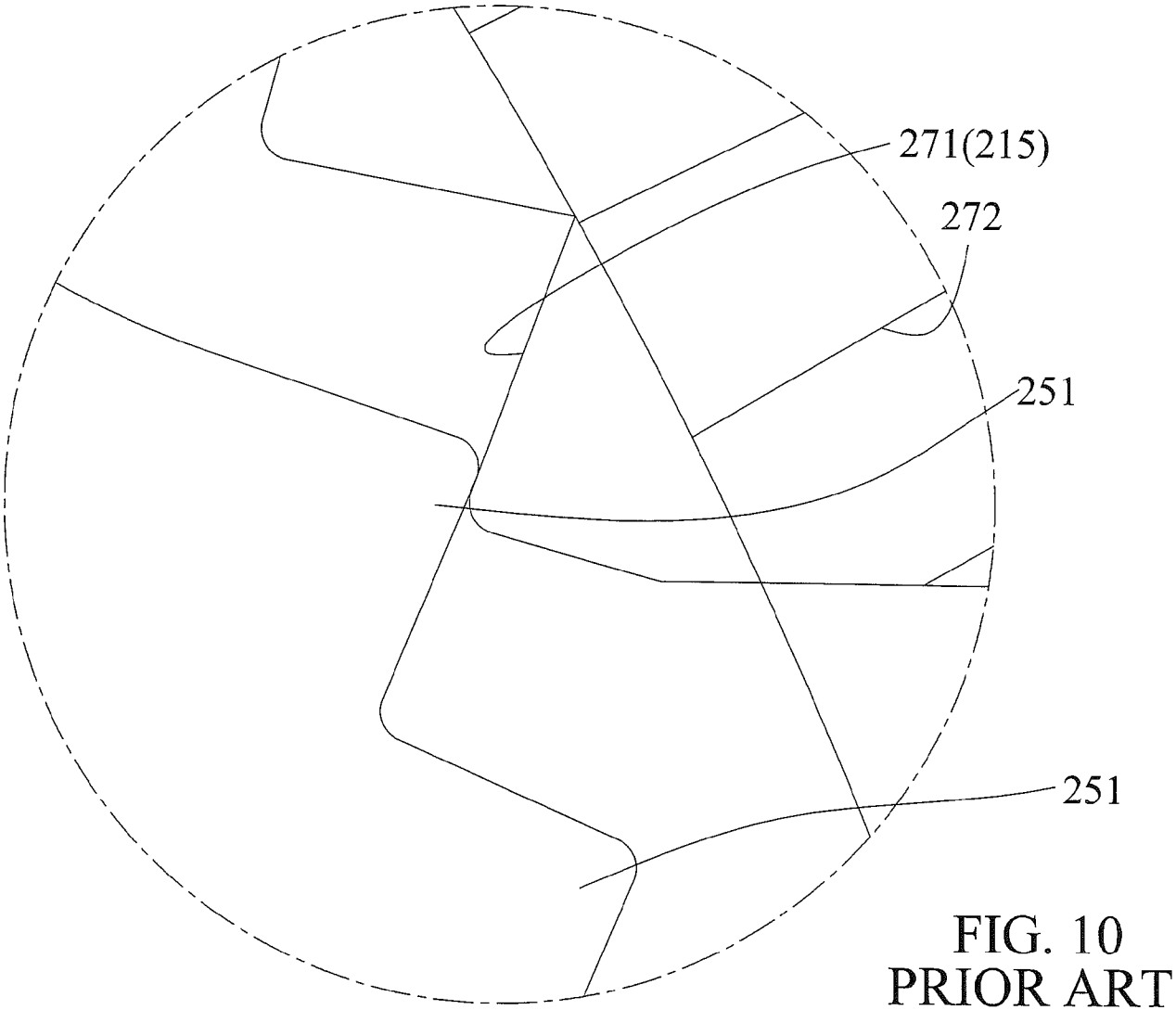
FIG. 10 PRIOR ART
FIG. 10 is an enlarged view of a circled portion of FIG. 9.
Figure 11:
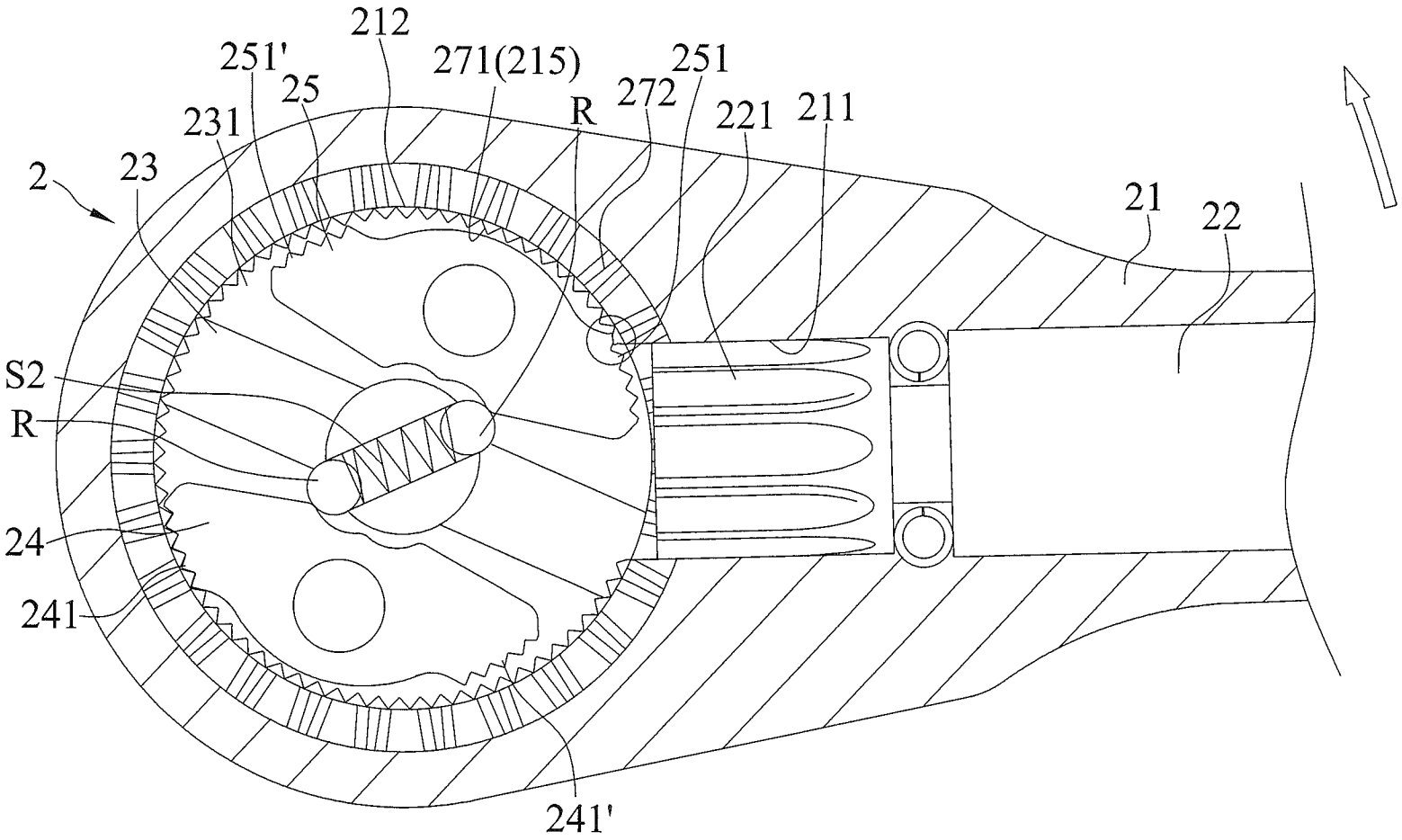
FIG. 11 PRIOR ART
FIG. 11 is a diagram showing a continuing operation on the ratchet wrench in the state shown in FIG. 10, illustrating tooth breakage due to the main body rotated while the first outer teeth of the second pawl and the inner teeth in the groove adjacent to the through-hole in a non-complete engagement.
Figure 12:
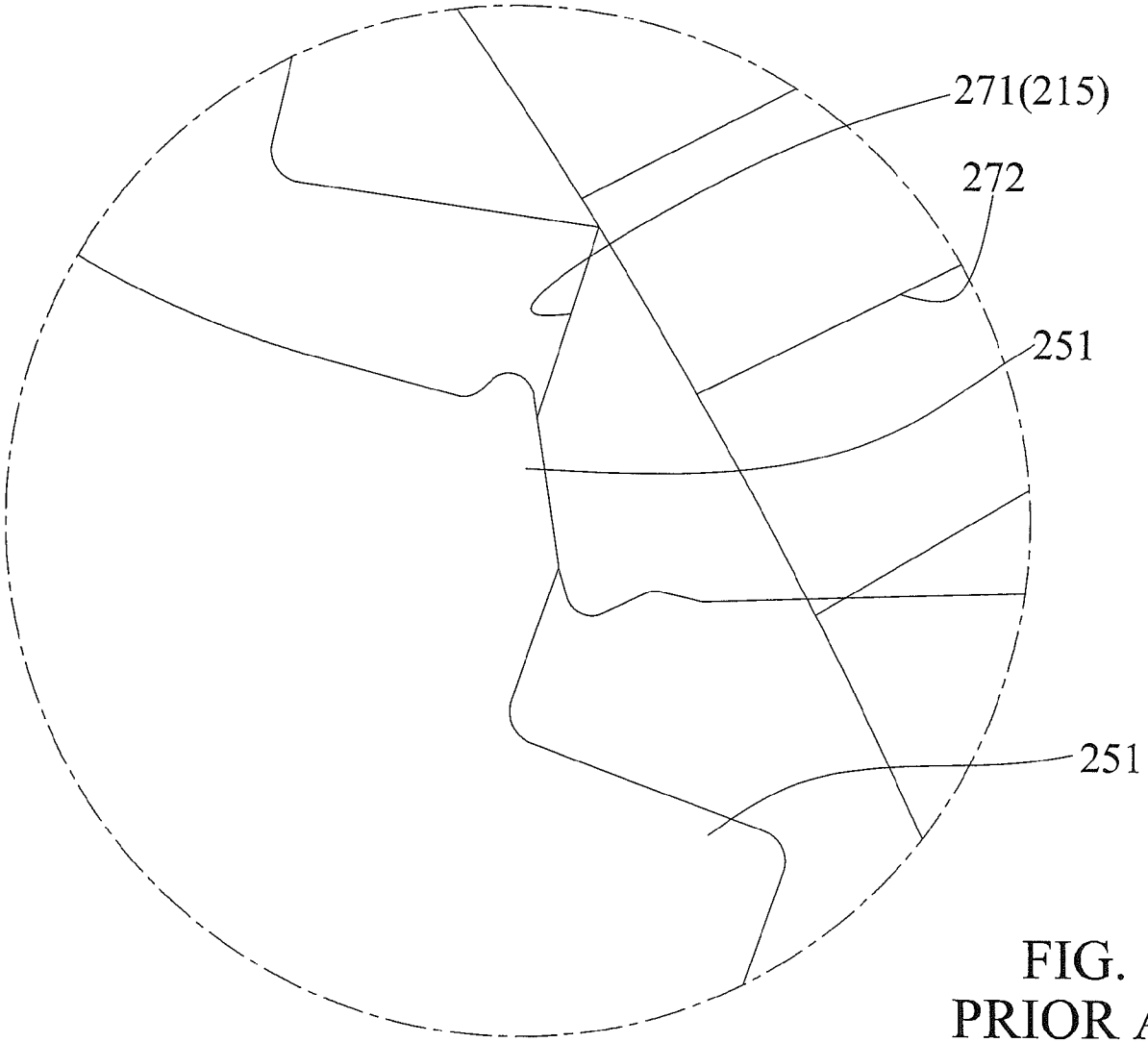
FIG. 12 PRIOR ART
FIG. 12 is an enlarged view of a circled portion of FIG. 11.

FIG. 5 shows a ratchet wrench with tooth breakage resistance of a second embodiment according to the present invention. The second embodiment is substantially the same as the first embodiment. The second embodiment is different from the first embodiment by that contact portion 61*b* of tooth breakage preventing device 60*b* includes a plurality of teeth having a plurality of tooth grooves 612*b* that is in selective contact with and engaged with one of first and second outer toothed sections 321 and 322 of either of the two first pawls 32. Furthermore, tooth grooves 612*b* are arranged in the circumferential direction of driving hole 11, and two of the tooth grooves 612*b* are respectively connected to two ends of toothed portion 111 of driving hole 11. Furthermore, the teeth of contact portion 61*b* and the teeth of tooth portion 111 of driving hole 11 together form a complete circle centered in rotating axis A of driving member 31.

Similar to the operation of the first embodiment, during repeated clockwise and counterclockwise rotations of body 10 to provide the ratcheting function, driving member 31 rotates relative to driving hole 11. When either of first pawls 32 reaches arcuate portion 113, contact portion 61*b* of tooth breakage preventing device 60*b* comes into contact with first outer toothed section 321 or second outer toothed section 322 of the first pawl 32, avoiding any tooth of first outer toothed section 321 or second outer toothed section 322 of the first pawl 32 from contacting with one of the teeth of toothed portion 111 contiguous to the corresponding adjoining portion 112. The force applied by the user is distributed to the structure of tooth breakage preventing device 60*b* while preventing tooth breakage resulting from application of a force by the user in a single-tooth engagement state before complete engagement between toothed portion 111 of driving hole 11 and first outer toothed section 321 or second outer toothed section 322.

Although specific embodiments have been illustrated and described, numerous modifications and variations are still possible without departing from the scope of the invention. The scope of the invention is limited by the accompanying claims.

The invention claimed is:

1. A ratchet wrench comprising:

a body including a driving hole and a transmission hole intersecting with the driving hole, with the driving hole including an inner periphery having a toothed portion with a plurality of teeth, with the inner periphery of the driving hole including two adjoining portions on opposite sides of the transmission hole in a circumferential direction of the driving hole, with an arcuate portion extending between the two adjoining portions and extending across the transmission hole in the circumferential direction of the driving hole;

a driving device rotatably received in the driving hole and adapted to drive a fastener, with the driving device including a driving member and two first pawls pivotably mounted to the driving member, with each of the first pawls including first and second outer toothed sections, with each of the first and second outer toothed sections having a plurality of teeth, with the first and second outer toothed sections of at least one of the first pawls selectively engaged with the toothed portion of the driving hole;

a transmission device rotatably mounted in the transmission hole, with the transmission device configured to drive the driving member to rotate relative to the driving hole about a rotating axis, and a tooth breakage preventing device mounted to an end of the transmission hole in the arcuate portion of the driving hole and located in the arcuate portion, with the tooth breakage preventing device being a separate member assembled with the body, with the tooth breakage preventing device including a contact portion configured to be selectively in contact with one of the first and second outer toothed sections of either of the two first pawls to prevent tooth breakage between the toothed portion of the driving hole and the one of the first and second outer toothed sections of either of the two first pawls when the body is rotated to provide a ratcheting function for driving the fastener, with the contact portion including a height extending from a circumference of a root circle of the toothed portion towards the driving hole in a radial direction of the root circle, and with each of the plurality of teeth of the toothed portion of the driving hole having a tooth height not larger than the height of the contact portion.

2. The ratchet wrench as claimed in claim 1, with the height of the contact portion being larger than the tooth height of the toothed portion of the driving hole, and with the contact portion being a protrusion extending from the circumference of the root circle of the toothed portion towards the driving hole in the radial direction of the root circle.

3. The ratchet wrench as claimed in claim 1, with the driving hole defined in an end of the body and extending along the rotating axis, with the contact portion of the tooth breakage preventing device having an arc length in the circumferential direction of the driving hole centered on the rotating axis, with each of the two first pawls including an arcuate section between the first and second outer toothed sections, with each of the first and second outer toothed sections including a plurality of teeth, with each of the plurality of teeth of each of the first and second outer toothed sections having a tooth thickness, and with a ratio of the arc length to the tooth thickness being not smaller than 0.5.

4. The ratchet wrench as claimed in claim 1, with the contact portion formed on an end of the tooth breakage preventing device, and with the contact portion being selectively in contact with one of the first and second outer toothed sections of either of the two first pawls.

5. The ratchet wrench as claimed in claim 4, with the contact portion having an arcuate face selectively in contact with one of the first and second outer toothed sections of either of the two first pawls.

6. The ratchet wrench as claimed in claim 5, wherein two of the plurality of teeth of the toothed portion of the driving hole respectively adjacent to the two adjoining portions have two first contact faces, respectively, with the contact portion including two second contact faces, with each of the two second contact faces being contiguous to one of two ends of the arcuate face, and with each of the two first contact faces and one of the two second contact faces defining a tooth groove that is selectively in contact with and engaged with one of the first and second outer toothed sections of either of the two first pawls.

7. The ratchet wrench as claimed in claim 4, with the contact portion including a plurality of tooth grooves, and with the plurality of tooth grooves being selectively in contact with and engaged with one of the first and second outer toothed sections of either of the two first pawls.

8. The ratchet wrench as claimed in claim 7, with the plurality of tooth grooves arranged in the circumferential direction of the driving hole, and with two of the plurality of tooth grooves respectively connected to two ends of the toothed portion of the driving hole.

9. The ratchet wrench as claimed in claim 8, with the contact portion including a plurality of teeth having the plurality of tooth grooves, and with the plurality of teeth of the contact portion and the plurality of teeth of the tooth portion of the driving hole together forming a complete circle centered in the rotating axis of the driving member.

10. The ratchet wrench as claimed in claim 1, with the tooth breakage preventing device including first and second ends spaced from each other along a longitudinal axis of the body perpendicular to the rotating axis, with the tooth breakage preventing device further including an axial hole extending from the first end through the second end along the longitudinal axis, with the tooth breakage preventing device further including a compartment located between the first and second ends and intersecting with the axial hole, with the compartment including upper and lower openings, with the transmission device including a transmission shaft rotatably received in the transmission hole and having an end received in the compartment, with a gear mounted on the end of the transmission shaft and received in the compartment, with the driving device further including two second pawls pivotably mounted to the driving member and two ring gears rotatably received in the driving hole, with each of the two ring gears including an inner toothed portion and a side toothed portion, with the side toothed portions of the two ring gears respectively meshed with the gear via the upper and lower openings, and with each of the two second pawls including two outer toothed sections selectively engaged with the inner toothed portion of one of the two ring gears.

11. The ratchet wrench as claimed in claim 10, further comprising a direction switching device operably coupled to the two first pawls and the two second pawls, with the direction switching device configured to change an engagement status between the two ring gears and the two first pawls and the two second pawls to change a ratcheting direction in which the fastener is driven by the driving member.

* * * * *